US008944545B2

(12) United States Patent
Chambers et al.

(10) Patent No.: US 8,944,545 B2
(45) Date of Patent: Feb. 3, 2015

(54) IMAGING DEVICE INCLUDING A PRINTHEAD CONTROLLED TO EJECT FLUID

(75) Inventors: Mark A. Chambers, Lexington, KY (US); Charles R. Minter, Boulder, CO (US)

(73) Assignee: Funai Electric Co., Ltd (JP)

( * ) Notice: Subject to any disclaimer, the term of this patent is extended or adjusted under 35 U.S.C. 154(b) by 466 days.

(21) Appl. No.: 12/951,210

(22) Filed: Nov. 22, 2010

(65) Prior Publication Data

US 2012/0127222 A1 May 24, 2012

(51) Int. Cl.
*B41J 29/38* (2006.01)
*B41J 2/165* (2006.01)

(52) U.S. Cl.
CPC ..... *B41J 2/165* (2013.01)
USPC ..... 347/5

(58) Field of Classification Search
CPC ..... B41J 2/165
USPC ..... 347/5, 19, 41, 15, 13, 9, 33, 35; 400/279; 358/1.2; 399/44
See application file for complete search history.

(56) References Cited

U.S. PATENT DOCUMENTS

| | | | | |
|---|---|---|---|---|
| 5,788,385 | A * | 8/1998 | Inoue et al. | 400/279 |
| 5,847,674 | A * | 12/1998 | Paroff et al. | 347/33 |
| 6,331,041 | B1 * | 12/2001 | Yoshimura et al. | 347/19 |
| 6,357,852 | B1 * | 3/2002 | Premnath et al. | 347/35 |
| 6,359,701 | B1 * | 3/2002 | Yamada et al. | 358/1.2 |
| 6,669,330 | B2 * | 12/2003 | Vanhooydonck et al. | 347/41 |
| 2005/0007405 | A1 * | 1/2005 | Shepherd et al. | 347/15 |
| 2006/0164457 | A1 * | 7/2006 | Little et al. | 347/19 |
| 2006/0209110 | A1 * | 9/2006 | Vinas et al. | 347/13 |
| 2009/0010662 | A1 * | 1/2009 | Naoi et al. | 399/44 |
| 2011/0227973 | A1 * | 9/2011 | Larson et al. | 347/9 |

* cited by examiner

*Primary Examiner* — Laura Martin
*Assistant Examiner* — Carlos A Martinez
(74) *Attorney, Agent, or Firm* — Amster, Rothstein, Ebenstein LLP

(57) ABSTRACT

An inkjet printer maintenance system that includes a processing unit adapted for running a print application corresponding to an image to be printed in response to a print input. The processing unit is further adapted to run a print driver that is capable of receiving a pixel data and information based on the print input. The inkjet printer maintenance system further includes a controller unit communicably coupled to the processing unit for receiving a print data from the print driver. Furthermore, the inkjet printer maintenance system includes a plurality of printhead enclosures communicably coupled to the controller unit. One or more printhead enclosures are adapted to receive the print data and information corresponding to a printing configuration for a printing operation. The information includes information about one of activating and deactivating multiple firing. Further disclosed is a method for maintenance of an inkjet printer.

5 Claims, 5 Drawing Sheets

IMAGING DEVICE INCLUDING A PRINTHEAD CONTROLLED TO EJECT FLUID

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to maintenance in imaging devices, such as printers, and more particularly, to an inkjet printer maintenance system.

2. Description of the Related Art

Industrial printing technology employs thermal inkjet printers for a variety of commercial printing applications, such as mail addressing and printing, and packaging coding and marking applications (i.e., printing on a product, on a primary packaging and/or on a secondary packaging). Typically, the aforementioned commercial printing applications entail the use of thermal inkjet printers that include stationary printheads (i.e., printheads provided at fixed positions within the thermal inkjet printers). In such thermal inkjet printers, target printing media (such as mail, boxes, products and the like) are allowed to move past the stationary printheads.

It has been observed that the stationary printheads are required to undergo maintenance very often in order to perform effective printing operations. However, difficulties have been encountered while performing traditional maintenance operations (such as spitting, wiping, capping and the like) that are required to keep the stationary printheads clean and unclogged/unplugged. Specifically, space constraints within the thermal inkjet printers make it difficult to perform the traditional maintenance operations for cleaning the stationary printheads effectively. Therefore, cleaning of such printheads involves either wiping the printheads manually or disposing damaged (clogged/plugged) printheads after use.

It has also been observed that production lines for the thermal inkjet printers are allowed to stop periodically in order to enable an operator to perform ancillary operations such as, setting-up or modifying the production lines, fixing problems, maintaining machines, and the like. Such production breaks may range from a few minutes to several hours. In such a situation, the thermal inkjet printers may undergo a transition from an idle (power-off) state to a printing state very quickly and without maintenance. Further, it has been observed that the thermal inkjet printers are powered down when printing stops for an extended time period (i.e., open time). However, the thermal inkjet printers may be left open to the atmosphere. An exposure to the atmosphere may cause clogging/plugging of nozzles of the printheads that may result in printing of images of a poor quality. The clogging/plugging of the nozzles may aggravate when the production lines are running at low speeds and the thermal inkjet printers are set for low resolutions in order to save ink.

Till date, various maintenance systems/approaches have been devised for rectifying the problems associated with clogged/plugged nozzles. However, such systems/approaches still have remained ineffective in rectifying the problems associated with the clogged/plugged nozzles.

Accordingly, there persists a need for an effective and efficient maintenance system and method for inkjet printers that enable the inkjet printers to print effectively even after being left open for an extended time period.

SUMMARY OF THE DISCLOSURE

In view of the foregoing disadvantages inherent in the prior art, the general purpose of the present disclosure is to provide an inkjet printer maintenance system and a method for maintenance of an inkjet printer, by including all the advantages of the prior art, and overcoming the drawbacks inherent therein.

The present disclosure provides an inkjet printer maintenance system. The inkjet printer maintenance system includes a processing unit adapted for running a print application corresponding to an image to be printed on a document in response to a print input. The processing unit is further adapted to run a print driver installed there within. The print driver is adapted to receive a pixel data corresponding to the image to be printed. The print driver is further adapted to receive information based on the print input. The information corresponds to printing the image at a first print resolution. The inkjet printer maintenance system further includes a controller unit communicably coupled to the processing unit for receiving a print data from the print driver based on the pixel data and the information received by the print driver. The controller unit is further adapted for transmitting the print data and information corresponding to a printing configuration based on the print data.

The inkjet printer maintenance system further includes a plurality of printhead enclosures communicably coupled to the controller unit. One or more printhead enclosures of the plurality of printhead enclosures are adapted to receive the print data and the information corresponding to the printing configuration transmitted by the controller unit for a printing operation. The information corresponding to the printing configuration includes information about one of activating and deactivating multiple firing from the one or more printhead enclosures during the printing operation. The multiple firing corresponds to printing of each picture element of the image at a predetermined frequency and at a second print resolution during the printing operation. The second print resolution is a predetermined multiple variable of the first print resolution. This can include integer multiples or other. Further, the multiple firing is activated for a first predetermined period, in response to determining the presence of the one or more printhead enclosures at an idle state for a second predetermined period.

In another aspect, the present disclosure provides a method for maintenance of an inkjet printer. The method includes running a print application on a processing unit. The print application corresponds to an image to be printed on a document in response to a print input. The method further includes transmitting a pixel data to a print driver of the processing unit. The pixel data corresponds to the image to be printed. Furthermore, the method includes transmitting information to the print driver based on the print input. The information corresponds to printing the image at a first print resolution. In addition, the method includes transmitting a print data from the print driver to a controller unit. The print data corresponds to the pixel data and the information received by the print driver. Moreover, the method includes transmitting the print data and information corresponding to a printing configuration from the controller unit to one or more printhead enclosures from a plurality of printhead enclosures communicably coupled with the controller unit. Additionally, the method includes determining the presence of the one or more printhead enclosures at an idle state for a first predetermined period. The method also includes initiating a printing operation to print the image on the document in response to determining the presence of the one or more printhead enclosures at the idle state for the first predetermined period. The printing operation includes activation of multiple firing from the one or more printhead enclosures for a second predetermined period. The multiple firing corresponds to printing of each picture element of the image at a predetermined frequency and at a second print resolution during the printing operation. The second print resolution is a predetermined multiple variable of the first print resolution.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure provides an inkjet printer maintenance system (hereinafter referred to as "system") that may be used for industrial inkjet printers supporting multiple printhead enclosures. The system includes a processing unit adapted for executing or running a print application. The system further includes a controller unit communicably coupled to the processing unit. Furthermore, the system includes a plurality of printhead enclosures communicably coupled to the controller unit. The system of the present disclosure is explained in conjunction with FIG. 1.

Figure 1:
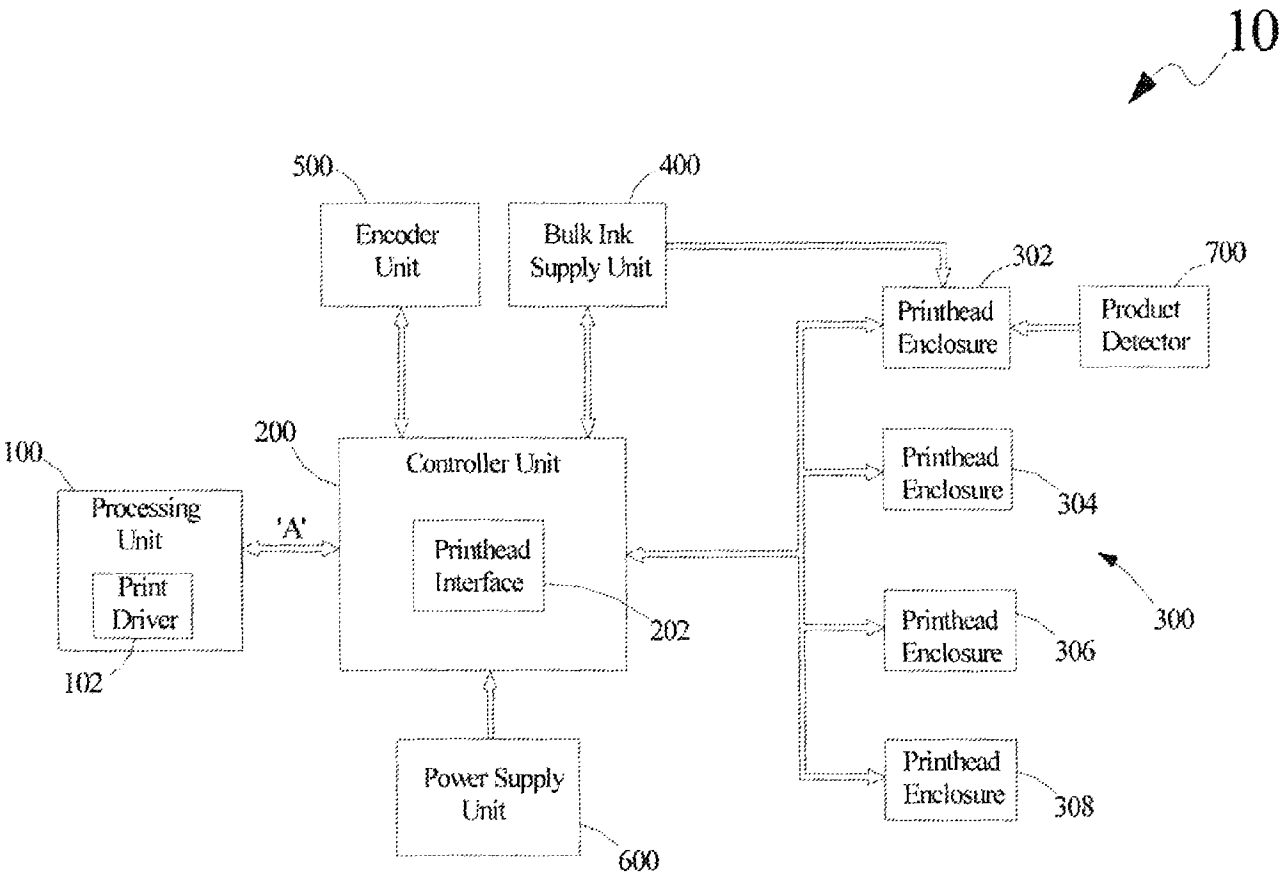
FIG. 1 illustrates a block diagram of an inkjet printer maintenance system.

FIG. 1 illustrates a block diagram of an inkjet printer maintenance system 10 (hereinafter referred to as "system 10"). The system 10 includes a processing unit 100. The processing unit 100 may be in the form of a computer, a laptop, and the like. The processing unit 100 is installed with one or more image processing and printing applications/software. Further, the processing unit 100 is adapted for executing or running a print application. The print application may correspond to an image that needs to be printed on a document (print medium) in response to a print input, such as an input provided by a user/operator. The processing unit 100 is further adapted to run a print driver 102 installed within the processing unit 100. The print driver 102 may be provided in the form of software that may be easily installed within the processing unit 100. The print driver 102 is adapted to receive a pixel data corresponding to the image to be printed. Further, the print driver 102 is adapted to split the pixel data into print swaths (such as print swaths of half inches) of a print data. In addition, the print driver 102 is capable of receiving information corresponding to the print input. The information may correspond to printing of the image at a first print resolution. Specifically, the user may specify a value for the first print resolution at which the image may be printed. More specifically, the first print resolution may be about 150 dots per inch (dpi).

The system 10 further includes a controller unit 200 as shown in FIG. 1. The controller unit 200 is communicably coupled to the processing unit 100 for receiving the print data from the print driver 102 of the processing unit 100. The print data received by the controller unit 200 is based on the pixel data of the image to be printed and the information corresponding to the print input. It is to be understood that the print data received by the controller unit 200 from the processing unit 100 is in a compatible format. The controller unit 200 is further adapted for transmitting the print data and an information corresponding to a printing configuration. The information corresponding to the printing configuration is based on the print data received by the controller unit 200. The controller unit 200 of the system 10 may be installed with software codes required for printing the image on the document. The controller unit 200 may be a universal print controller that may facilitate the operation of the system 10 with the help of programmed commands defining set parameters required for printing the image on the document. Alternatively, a communication program, such as a terminal emulator may also be used as the controller unit 200.

Further, the system 10 includes a plurality of printhead enclosures. Specifically, the system 10 includes printhead enclosures 302, 304, 306 and 308 (collectively referred as "printhead enclosures 300") as shown in FIG. 1. For the purpose of this description, only four printhead enclosures are depicted in the system 10. They represent inkjet printheads, such as those dedicated to imaging with a common color or individual colors like cyan, magenta, yellow and black. However, it will be evident that the system 10 may include any number of printhead enclosures depending on various printing applications. Each printhead enclosure of the printhead enclosures 300 is communicably coupled to the controller unit 200. Specifically, each printhead enclosure of the printhead enclosures 300 is coupled to the controller unit 200 through a printhead interface 202 of the controller unit 200. The printhead interface 202 facilitates transfer of the print data and the information corresponding to the printing configuration, from the controller unit 200 to the one or more printhead enclosures in a compatible format. The data is then used to eject fluid or not from fluid ejection elements of the printhead. It should be understood that the printhead interface 202 may be installed with respective software codes required for printing the image on the document.

The information corresponding to the printing configuration transmitted by the controller unit 200 to the one or more printhead enclosures includes information about one of activating and deactivating multiple firing from the one or more printhead enclosures during the printing operation. Specifically, the information may be transmitted as commands from the controller unit 200 to the one or more printhead enclosures for either activating or deactivating multiple firing from the one or more printhead enclosures during the printing operation. More specifically, commands such as "multi_fire" may be used for either activating or deactivating the multiple firing.

The term 'multiple firing,' as used herein, corresponds to printing of each picture element of the image at a predetermined frequency and at a second print resolution during the printing operation. The second print resolution is set to be a predetermined multiple variable of the first print resolution. Resolution parameters for multiple firing may be set using a command, such as a "setresparam" command that may be programmed based on a particular inkjet printer maintenance system, such as the system 10. As an example, the each picture element of the image may be printed at a predetermined frequency, such as 1 Kilo Hertz (KHz) of firing frequency, and at a second print resolution of about 600 dpi. Accordingly, the second print resolution of about 600 dpi is a predetermined multiple variable (four times) of the first print resolution of about 150 dpi. The value of the predetermined variable that is used for multiplying the first print resolution is limited by speed of belt (not shown) of an inkjet printer employing the system 10 and the maximum firing frequency (such as 6 KHz). Further, the one or more printhead enclosure may fire each picture element up to four times without exceeding 600 picture elements per inch in the direction of a printing.

Further, the multiple firing is activated for a first predetermined time, in response to determining the presence of the one or more printhead enclosures at an idle state for a second predetermined period, such as half an hour, three hours and the like. The first predetermined time for the multiple firing may be a time period that may either be a time period required for printing the document in its entirety or a time period required for printing a few lines on the document. It is to be understood that the first predetermined period may be set as per the requirement for a specific printing application. In addition, the multiple firing may be activated when the system 10 is powered-up as the one or more printhead enclosures may have remained idle for an extended time period. Also, the idle state of the one or more printhead enclosures may also relate to a state when a programmable time limit has exceeded since a last printing operation has been performed.

Further, the one or more printhead enclosures of the printhead enclosures 300 are adapted to determine a type of ink available. In addition, the one or more printhead enclosures are adapted to transmit information corresponding to the type of ink required for the printing operation, to the controller unit 200. Moreover, each printhead enclosure of the one or more printhead enclosures is adapted to receive an indication and to track the document after receiving the indication in order to initiate the printing operation based on the print data and the information corresponding to the printing configuration transmitted by the controller unit 200.

As depicted in FIG. 1, the system 10 further includes a bulk ink supply unit 400. The bulk ink supply unit 400 is coupled to the controller unit 200 and the one or more printhead enclosures of the printhead enclosures 300. The bulk ink supply unit 400 is further adapted to supply ink to the one or more printhead enclosures for the printing operation. Specifically, the bulk ink supply unit 400 is capable of supplying ink to the one or more printhead enclosures depending on the information corresponding to the printing configuration transmitted by the controller unit 200 and the information corresponding to the type of ink required for the printing operation transmitted by the one or more printhead enclosures to the controller unit 200.

Further, the system 10 includes an encoder unit 500, as shown in FIG. 1 of the present disclosure. The encoder unit 500 is communicably coupled to the controller unit 200. The encoder unit 500 is adapted to transmit an input to the controller unit 200. The input to the controller unit 200 corresponds to a position reference of the document to be printed. The position reference of the document to be printed may correspond to an area on the document where printing is to be carried out.

Moreover, the system 10 includes a power supply unit 600 coupled to the controller unit 200 for supplying power to the controller unit 200.

Further, the system 10 includes a product detector communicably coupled to each printhead enclosure of the one or more printhead enclosures. For the purpose of this description, the system 10 is shown to include a product detector 700 communicably coupled to the printhead enclosure 302. The product detector 700 may be in the form of a sensor and is adapted to detect the presence of the document in proximity to a printing zone of the printhead enclosure 302.

In another aspect, the present disclosure provides a method for maintenance of an inkjet printer. The method for maintenance of the inkjet printer is explained in conjunction with FIGS. 2A and 2B. Further, the method is explained herein below while referring to the system 10 and components thereof, as explained in conjunction with FIG. 1.

Figure 2A:
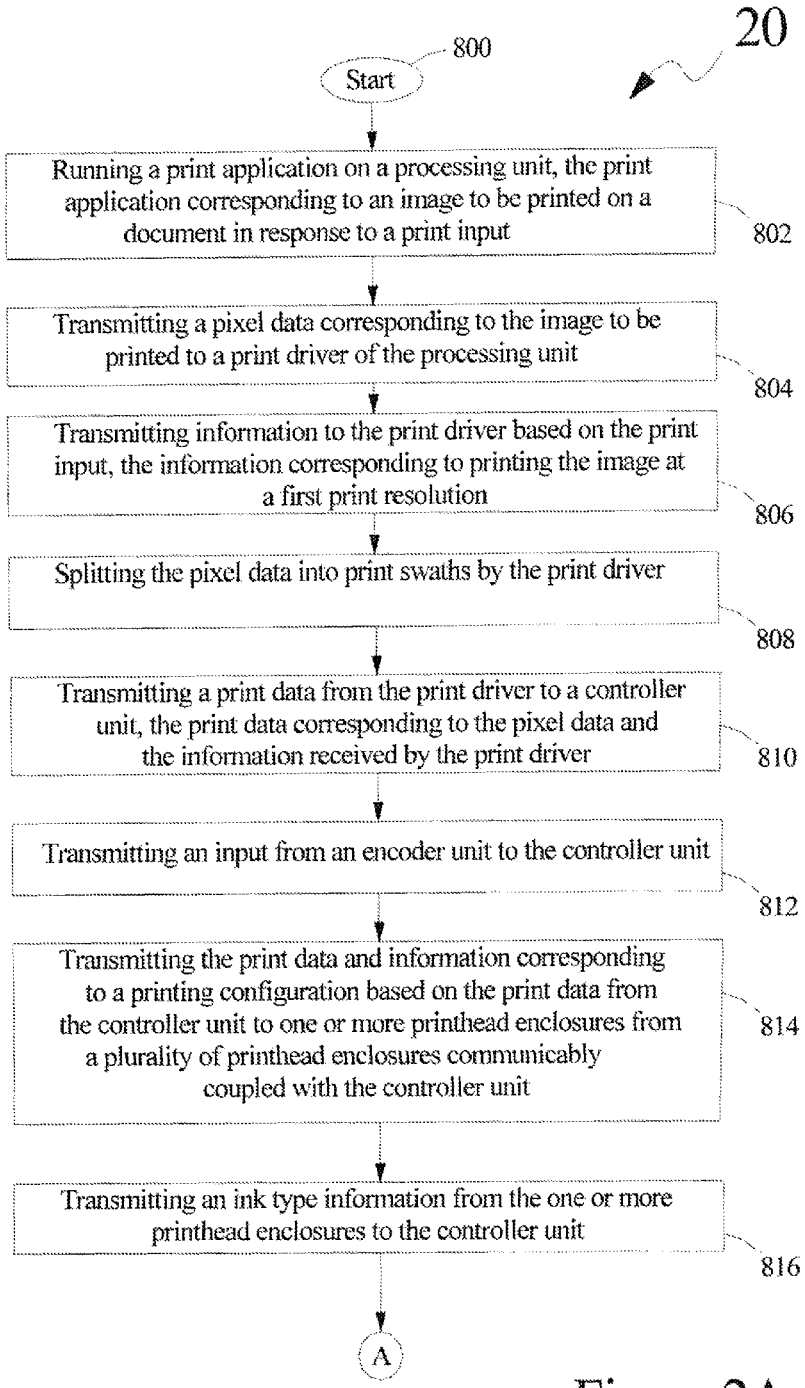
FIG. 2A and FIG. 2B illustrate a flow diagram for a method for maintenance of an inkjet printer.
Figure 2B:
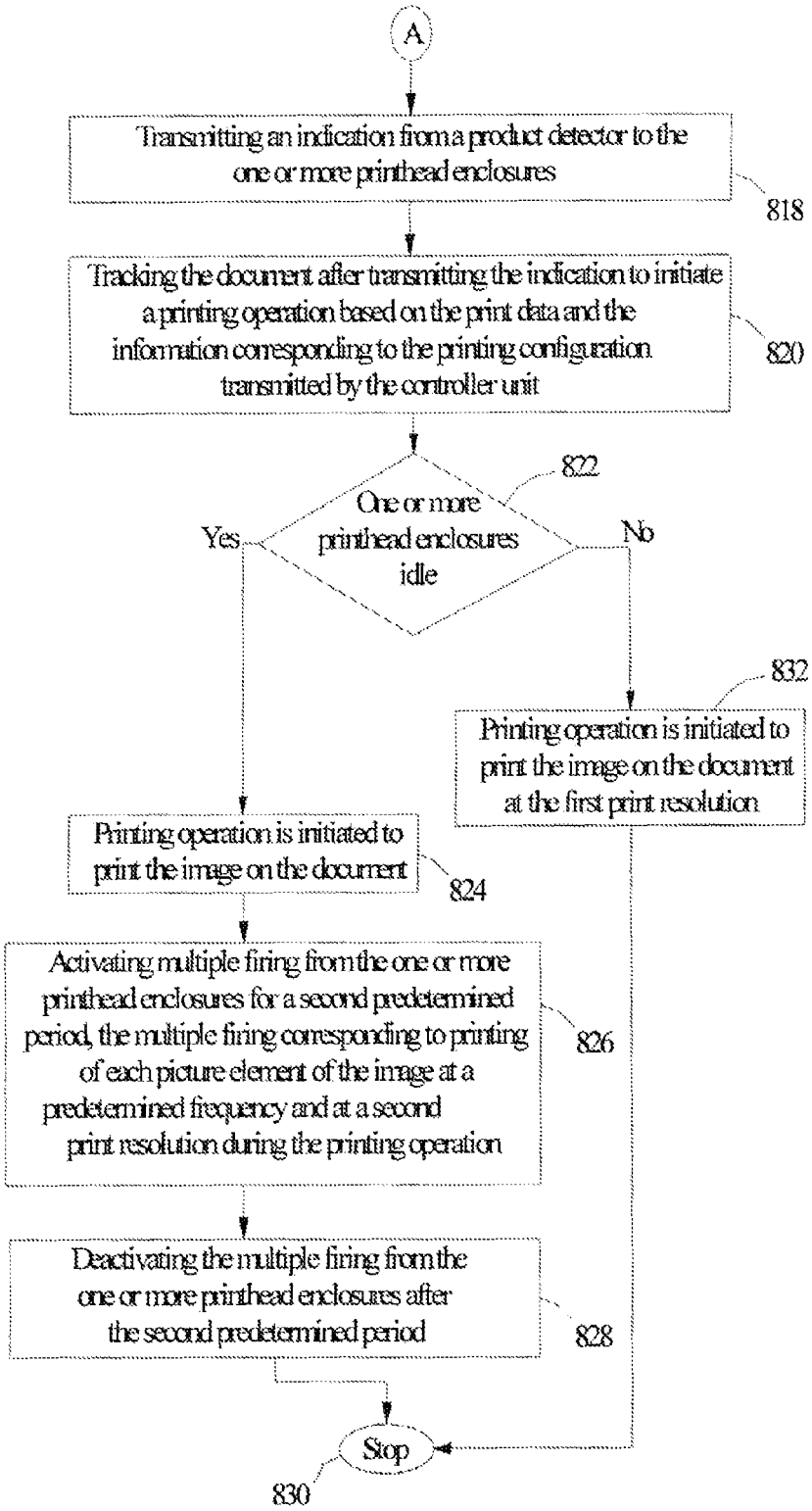

FIGS. 2A and 2B illustrate a flow diagram for a method 20 for maintenance of an inkjet printer. The method 20 starts at 800. At 802, a print application is run on the processing unit 100 of the system 10. The print application corresponds to an image to be printed on a document in response to a print input, such as a user input. At 804, a pixel data corresponding to the image to be printed is transmitted to the print driver 102 of the processing unit 100. At 806, information based on the print input and corresponding to printing the image at a first print resolution is transmitted to the print driver 102. At 808, the pixel data corresponding to the image to be printed transmitted to the print driver 102 is split into print swaths by the print driver 102. At 810, a print data from the print driver 102 is transmitted to the controller unit 200. The print data corresponds to the pixel data, and more specifically, to the print swaths, and the information received by the print driver 102.

At 812, an input from an encoder unit 500 is transmitted to the controller unit 200. As explained in conjunction with FIG. 1, the encoder unit 500 is communicably coupled to the controller unit 200. At 814, the print data and information corresponding to a printing configuration, based on the print data, is transmitted from the controller unit 200 to the one or more printhead enclosures of the printhead enclosures 300 that are communicably coupled with the controller unit 200 through a plurality of serial data cables. At 816, an ink-type information from the one or more printhead enclosures is transmitted to the controller unit 200.

Further, at 818 an indication from the product detector 700 is transmitted to the one or more printhead enclosures. As explained in conjunction with FIG. 1, the product detector 700 is communicably coupled to the one or more printhead enclosures. At 820, the document is tracked after transmitting the indication to the one or more printhead enclosures to initiate a printing operation based on the print data and the information corresponding to the printing configuration transmitted by the controller unit 200.

At 822, the presence of the one or more printhead enclosures being at an idle state for a first predetermined period is determined. The first predetermined period is defined in conjunction with FIG. 1, and accordingly, the same has not been explained here for the sake of brevity. At 824, the printing operation is initiated to print the image on the document in response to determining the presence of the one or more printhead enclosures being at an idle state for the first predetermined period. At 826, multiple firing is activated from the one or more printhead enclosures for a second predetermined period. The second predetermined period is defined in conjunction with FIG. 1, and accordingly, the same has not been explained here for the sake of brevity. The term 'multiple firing,' as used herein above, corresponds to printing of each picture element of the image at a predetermined frequency and at a second print resolution during the printing operation. The second print resolution is a predetermined multiple variable of the first print resolution. The second print resolution is defined in conjunction with FIG. 1, and accordingly, the same has not been explained here for the sake of brevity. At 828, the multiple firing is deactivated from the one or more printhead enclosures at the end of the second predetermined period. At 830, the method 20 stops.

The method 20 also includes initiation of the printing operation to print the image on the document at the first print resolution, in response to the absence of the one or more printhead enclosures at the idle state for the first predetermined period, at step 832. At 830, the method 20 stops.

EXAMPLE

The following example explains a prototype of the system 10 that incorporates the method 20 of FIGS. 2A and 2B. Specifically, the example depicts before and after results (images of 10-barcode) that show an improvement in decap performance of an inkjet printer that includes four print head enclosures, such as the printhead enclosures 300. Printheads within the printhead enclosures 300 were held stationary as a document was allowed to move from a first direction (right) to a second direction (left) at a speed of about 15 feet per minute.

Figure 3:
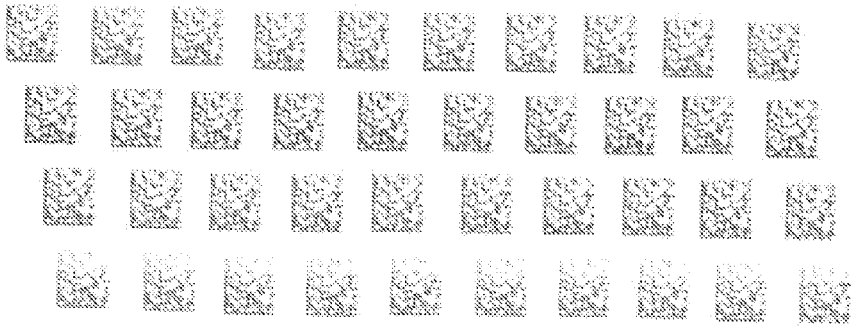
FIG. 3 depicts an image of a 10-barcode for an inkjet printer including a plurality of printheads that is clean and fresh.

The controller unit 200 was installed with respective software codes required for a printing operation. Further, the encoder unit 500 and the product detector 700 were set-up. The processing unit 100 was connected to the controller unit 200 via a serial cable 'A', as shown in FIG. 1. Thereafter, the print input was provided to the processing unit 100. The document was then fed to the printing zone near the printhead enclosures. As the product detector 700 detected the presence of the document in proximity to respective printing zones of the printhead enclosures 300, a counting mechanism was initiated to count the predetermined period for printing. Subsequently, an image of a 10-barcode was obtained as shown in FIG. 3.

Figure 4:
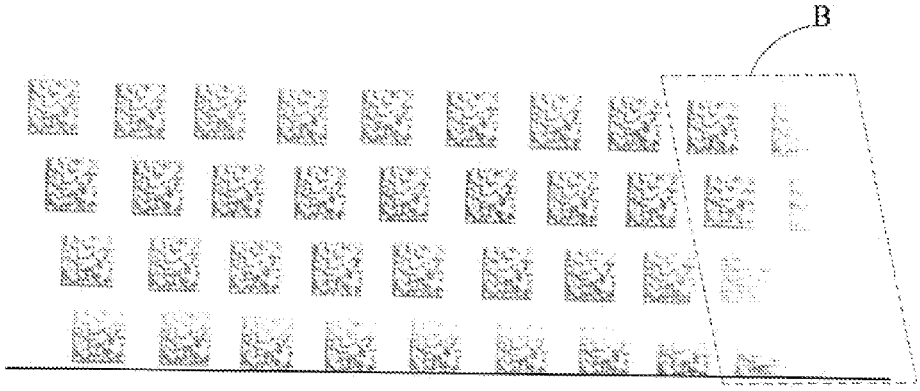
FIG. 4 depicts an image of a 10-barcode for the inkjet printer including the plurality of printheads present in a de-caped state for thirty minutes.
Figure 5:
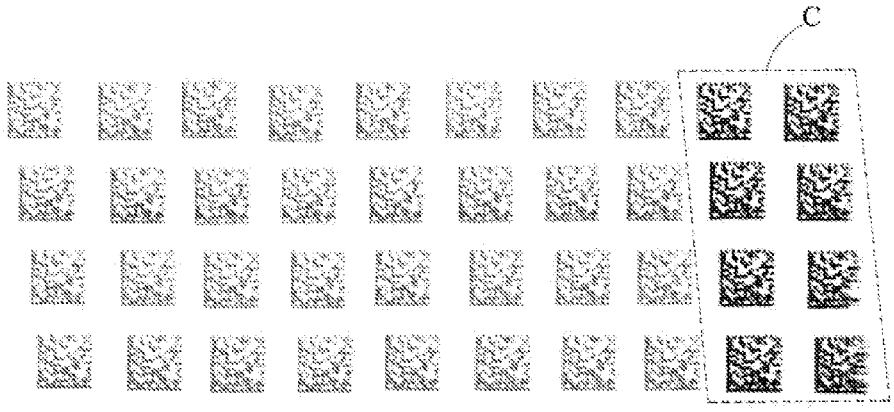
FIG. 5 depicts an image of a 10-barcode for the inkjet printer including the plurality of printheads that is present in the de-caped state for thirty minutes and is allowed to initiate multiple firing.

The system 10 was then left idle (in a decap state) for a certain period, such as half an hour, and then the print data and the information corresponding to the printing configuration was fed to the printhead enclosures 300 without the multiple firing activation. FIG. 4 depicts an image of the 10-barcode without the activation of the multiple firing. More specifically, a rectangular box 'B' depicts an area that shows printing of poor quality. FIG. 5 depicts an image of the 10-barcode when the system 10 was left idle (in the decap state) for half an hour, and then the print data and the information corresponding to the printing configuration was fed to the printhead enclosures 300 with the multiple firing activation. As depicted in FIG. 5, a dramatic improvement in readability of codes printed after the activation of the multiple firing may be observed (as shown by an area confined within a rectangular box 'C').

Figure 6:
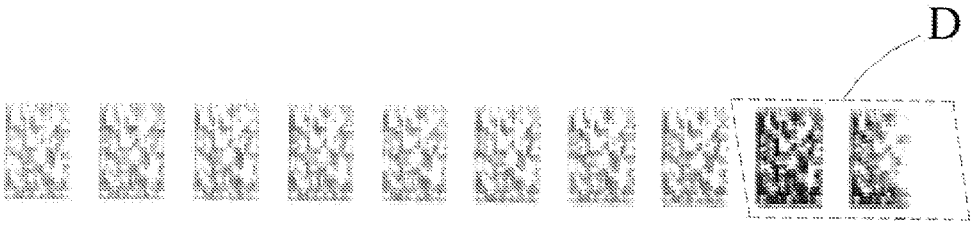
FIG. 6 depicts an image of a 10-barcode for the inkjet printer obtained after three hours under a first set of conditions.
Figure 7:
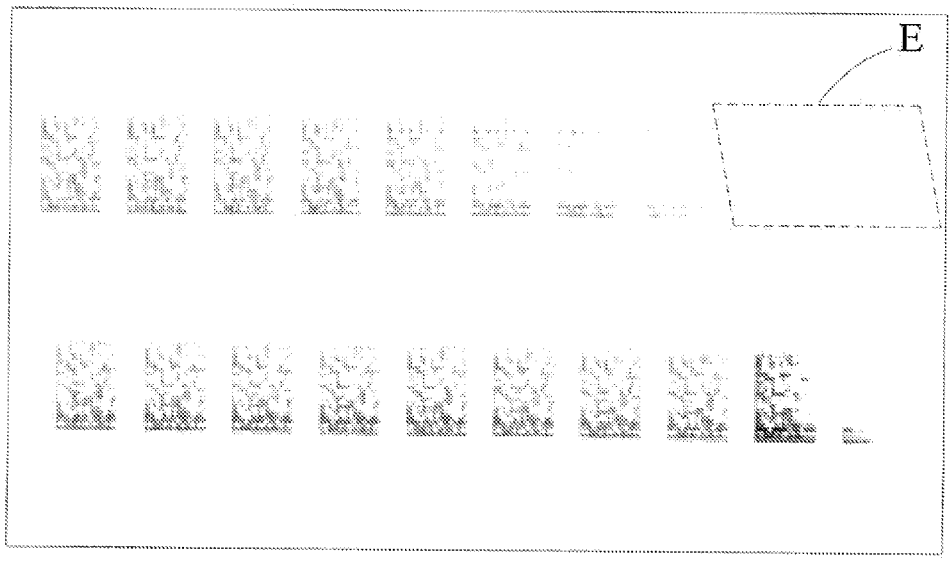
FIG. 7 depicts an image of a 10-barcode for the inkjet printer obtained after ten hours under a second set of conditions.

Referring to FIG. 6 and FIG. 7, the image of the 10-bar code was also obtained under specific conditions in addition to the activation of multiple firing. Specifically, FIG. 6 depicts an image of the 10-barcode obtained after keeping the system 10 idle for three hours in the decap state, at a room temperature of about 71 Fahrenheit (F.) and humidity of about 63%. More specifically, a rectangular box 'D' depicts a confined area in FIG. 6 obtained after keeping the system 10 idle for three hours in the decap state while the multiple firing was activated. FIG. 7 depicts an image of the 10-bar code obtained before keeping the system 10 idle for 10 hours in the decap state, at a room temperature of about 71 F. and humidity of about 38% without the activation of the multiple firing (as shown by an area confined within a rectangular box 'E'). FIG. 7 also depicts an image of the 10-bar code obtained after keeping the system 10 idle for 10 hours in the decap state, at a room temperature of about 71 F. and humidity of about 62% with the activation of the multiple firing (as shown by an area confined within a rectangular box 'F').

Based on the foregoing, the present disclosure provides an efficient and effective system (such as the system 10) and method (such as the method 20) for maintenance of inkjet printers that enable the inkjet printers to print effectively even after being left open for an extended time period. The system and the method of the present disclosure reduce the amount of printing required to open clogged nozzles of printheads of the inkjet printers. Further, the system and the method provide an improved quality of a first image, thereby resulting in less wastage of resources. Also, the system and the method provide a second image with an improved readability even when printed at 150 dots per inch (dpi) and at low speed. The system and the method are capable of utilizing an insignificant amount of ink while maintaining the inkjet printers. Furthermore, the system and the method are adapted as self-contained features within a printing subsystem.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. An imaging device, comprising:

a controller configured to receive from a host device imaging data at a first resolution; and at least one printhead having fluid ejection elements caused to fire or not by the controller, wherein the controller increases the imaging data at the first resolution to imaging data at a second resolution that is higher than the first resolution of the imaging data so the fluid ejection elements operate more frequently to eject fluid onto a recording medium into an image corresponding to the imaging data at the second resolution than the fluid ejection elements would otherwise operate at the first resolution of the imaging data, wherein the controller is configured to increase the imaging data at the first resolution to the imaging data at the second resolution after the imaging device is idle for a predetermined period of time.

2. The imaging device of claim 1, wherein the controller is configured to said increase the imaging data at the first resolution to the imaging data at the second resolution when a frequency of firing of the fluid ejection elements with the imaging data at the first resolution is less than about 6 khz.

3. The imaging device of claim 1, wherein the controller is further configured to maintain the imaging data at the second resolution for the at least one printhead for a distance of about one to three inches of printing.

4. The imaging device of claim 1, wherein the controller is configured to said increase the imaging data at the first resolution to the imaging data at the second resolution when the imaging device is initially powered on.

5. The imaging device of claim 1, wherein the controller is configured to said increase the imaging data at the first resolution to the imaging data at the second resolution when a predetermined time limit has been exceeded since imaging a previous imaging job with the fluid ejection elements.

* * * * *